US008424479B1

(12) United States Patent
Caccamo

(10) Patent No.: US 8,424,479 B1
(45) Date of Patent: Apr. 23, 2013

(54) UNIVERSAL LAUNCH AND RECOVERY SYSTEM

(75) Inventor: Matthew P Caccamo, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 105 days.

(21) Appl. No.: 13/034,061

(22) Filed: Feb. 24, 2011

Related U.S. Application Data

(60) Provisional application No. 61/359,238, filed on Jun. 28, 2010.

(51) Int. Cl.
*B63B 35/40* (2006.01)

(52) U.S. Cl.
USPC ..... 114/259

(58) Field of Classification Search ..... 114/44, 114/45, 258, 259; 405/1, 7
See application file for complete search history.

(56) References Cited

U.S. PATENT DOCUMENTS

| | | | | |
|---|---|---|---|---|
| 2,554,398 | A * | 5/1951 | Brei | 193/42 |
| 3,734,046 | A * | 5/1973 | Schmidt et al. | 114/259 |
| 4,391,550 | A * | 7/1983 | Rutter | 405/7 |
| 4,714,375 | A * | 12/1987 | Stevenson et al. | 405/3 |
| 5,186,576 | A * | 2/1993 | Fournier | 405/7 |
| 5,228,713 | A | 7/1993 | Kovach | |
| 6,575,487 | B1 | 6/2003 | Krause | |
| 7,581,507 | B2 * | 9/2009 | Kern | 114/259 |

* cited by examiner

*Primary Examiner* — Stephen Avila
(74) *Attorney, Agent, or Firm* — Dave A. Ghatt

(57) ABSTRACT

A universal launch and recovery system that may be used to launch or recover/receive water vessels. The launch and recovery system includes a deployable ramp having adjustable soft end guides and adjustable tire arrangements for guiding and cushioning vessels of different geometries.

18 Claims, 6 Drawing Sheets

UNIVERSAL LAUNCH AND RECOVERY SYSTEM

CROSS-REFERENCE TO RELATED APPLICATIONS

This application claims the benefit of U.S. Provisional Application No. 61/359,238, filed Jun. 28, 2010, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a universal launch and recovery system, more particularly a launch and recovery system including a deployable ramp having adjustable soft end guides and adjustable tire arrangements for cushioning and guiding vessels of different geometries.

BACKGROUND

The recovery of smaller surface water vessels, such as manned or unmanned surface water vessels (USVs), by larger parent ships is an emerging technology. Once recovered by the parent ship, servicing operations such as fueling and general maintenance may be performed. Typically, the recovery of a smaller vessel is accomplished by driving the smaller vessel alongside a stationary parent ship and lifted by davit into the ship. Alternatively, the smaller water vessel may be driven up a ramp into the larger ship.

Traditional methods of launching and recovering/receiving smaller surface water vessels can cause damage to the hull of the smaller vessel. For example, some USVs weigh about 20,000 lbs and are made from materials such as aluminum. A recovering method that for example, requires a USV to be driven into a parent ship or be lifted and dropped onto the parent ship can cause damage to the aluminum hull, resulting in expensive repairs. The prior art does not teach an operator-friendly method and apparatus that launches and recovers a smaller vessel in a cushioned and properly guided manner that prevents damage to the smaller vessel, in which the apparatus is capable of capturing smaller vessels having a range of different hull geometries.

SUMMARY

In one aspect, the invention is a universal launch and recovery system. The system includes a pivotable ramp having a forward edge and a pivot edge, with the pivotable ramp pivotable at the pivot edge, the forward edge being movable between a stowed position and deployed position for receiving a water vessel. In this aspect, the pivotable ramp includes a substantially planar ramp surface with a first row of tire arrangements, and a second row of tire arrangements. The second row of tire arrangements is substantially parallel to the first row of tire arrangements. Each tire arrangement includes an adjustable pivotable joint attached to the substantially planar ramp surface. Each tire arrangement further includes an extendable arm having a lower portion and an upper portion, wherein the lower portion of the extendable arm is attached to the pivotable joint. Each tire arrangement also includes an axle attached to the upper portion of the extendable arm, and a tire for supporting a water vessel and for moving the water vessel along the ramp, the tire attached to the axle, wherein the tire is rotatable about the axle.

In another aspect, the invention is an arrangement for launching and receiving multiple water vessels of various geometries. The arrangement includes a pivotable ramp having a forward edge, a pivot edge, a first side edge, and a second side edge. The forward and the pivot edges are substantially perpendicular to the first and second side edges. In this aspect, the pivotable ramp is pivotable at the pivot edge so that the ramp moves between a stowed position and deployed position for receiving a water vessel. The pivotable ramp includes a first set of vertically arranged soft entry guide bars positioned along the first side edge of the ramp for guiding water vessels of various geometries onto and off of the ramp. The pivotable ramp also includes a second set of vertically arranged adjustable soft entry guide bars substantially parallel to the first set of vertically arranged soft entry guide bars for guiding water vessels of various geometries onto and off of the ramp. The second set of vertically arranged adjustable soft entry guide bars are positioned along the second side edge of the ramp, the first and second set of vertically arranged soft entry guide bars guiding water vessels onto and off the pivotable ramp.

In another aspect, the invention is an at sea method of launching and/or receiving water vessels having different geometries. In this aspect, the method includes providing a ship having a ramp. The ship ramp includes a first set of vertically arranged laterally adjustable soft entry guide bars positioned along a first side edge of the ramp, and a second set of vertically arranged laterally adjustable soft entry guide bars substantially parallel to the first set of vertically arranged soft entry guide bars, and positioned along a second side edge of the ramp. The ship ramp also includes a first row of tire arrangements having tires mounted on a pivotable and extendable arm. The ship ramp further includes a second row of tire arrangements, substantially parallel to the first row of tire arrangements, comprising tires mounted on a pivotable and extendable arm, each of the first row and second row of tire arrangements positioned between the first and second set of vertically arranged soft entry guide bars. According to this aspect, the method further includes selecting one of a plurality of water vessels having different geometries for launching from the ship or for receiving onto the ship. The method further includes adjusting the lateral positioning of the first and second set of vertically arranged laterally adjustable soft entry guide bars to a position commensurate with the geometry of the selected water vessel. In this aspect, the method further includes adjusting the pivot angle and the extension length of each arm of first and second rows of tire arrangements to an angle and an extension length commensurate with the geometry of the selected water vessel. The at sea method of launching and/or receiving water vessels having different geometries also includes moving the ramp to a deployed position in which a forward edge is submerged beneath the surrounding water, and using the ramp to cushion and guide the selected water vessel onto the ship during launching or off the ship during receiving.

BRIEF DESCRIPTION OF THE DRAWINGS

Other features will be apparent from the description, the drawings, and the claims.

DETAILED DESCRIPTION

Figure 1:
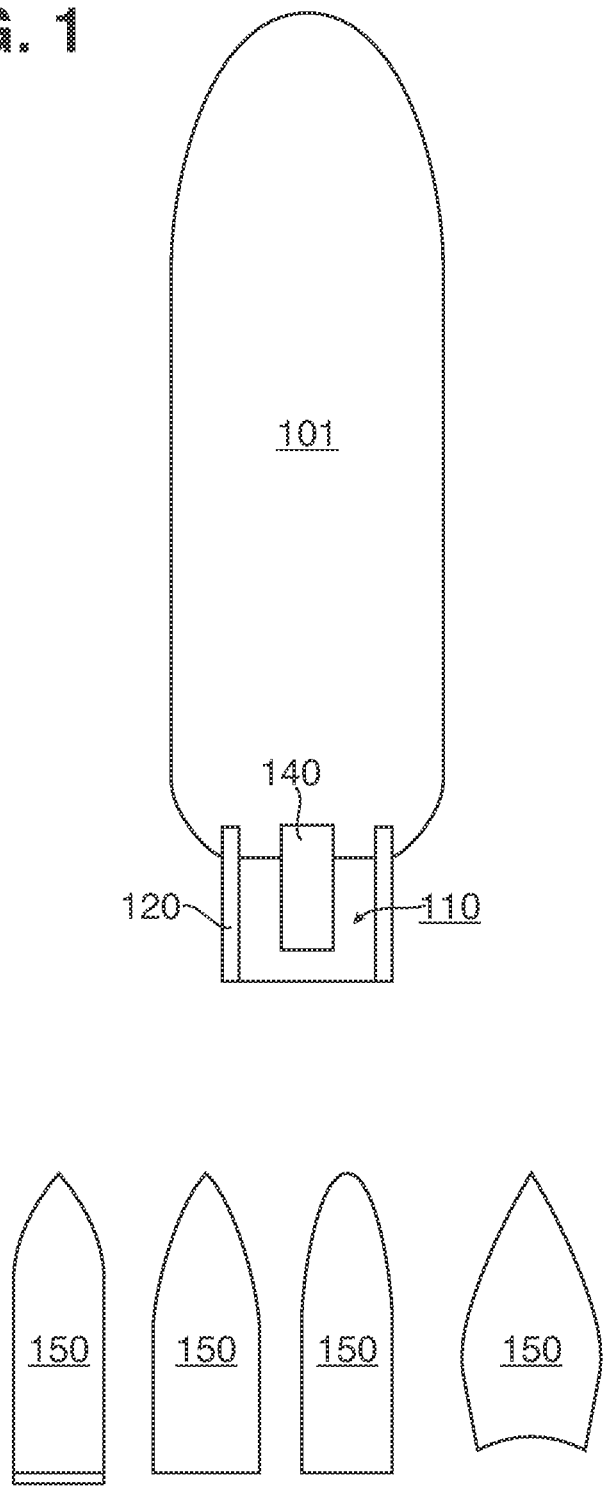
FIG. 1 is a schematic illustration of a universal launch and recovery system for launching and receiving water vessels having different geometries, according to an embodiment of the invention.

FIG. 1 is a schematic illustration of a universal launch and recovery system 100 for launching and recovering/receiving water vessels having different geometries. As shown, the launch and recovery system 100 includes a ramp 110, which as outlined below is pivotable between a stowed position and a deployed position. FIG. 1 shows schematically shows vertical guide bar sets 120 at outer side edges of the ramp 110. The system 100 also includes a plurality of tire arrangements 140 at a central region of the ramp 110.

FIG. 1 shows the ramp 110 attached to a parent ship 101. The parent ship 101 may be a carrier or a cargo ship for carrying one or more smaller water vessels 150 on a cargo deck 105. As outlined below, the ramp 110 including the vertical guide bar sets 120 and the tire arrangements 140 are provided to launch and/or recover the smaller water vessels, while at sea. FIG. 1 shows vessels 150 having different beams and generally different hull geometries. The vessels 150 are provided merely as examples of a myriad of smaller vessels having different geometries, which could be launched or received by the parent ship 101. The water vessel 150 may be any type of vessel that can be carried by the parent ship 101, and may be manned or unmanned. Additionally, as opposed to a parent ship 101, the ramp 110 may be attached to a fixed structure, such as a loading dock, and would thus facilitate the launching and recovering of vessels from and to fixed structures.

Figure 2A:
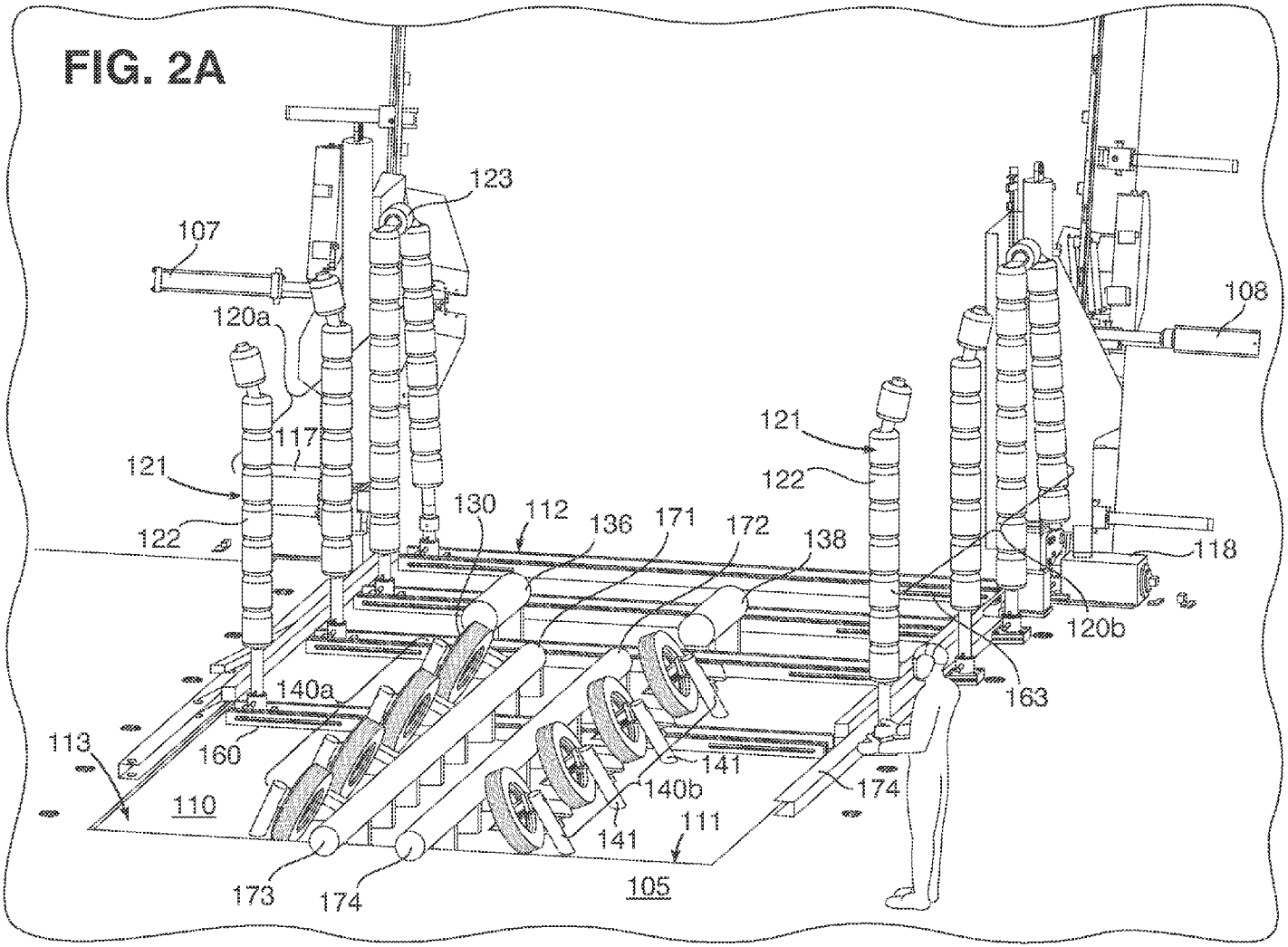
FIGS. 2A-2B are exemplary illustrations of a universal launch and recovery arrangement, according to embodiments of the invention.
Figure 2B:
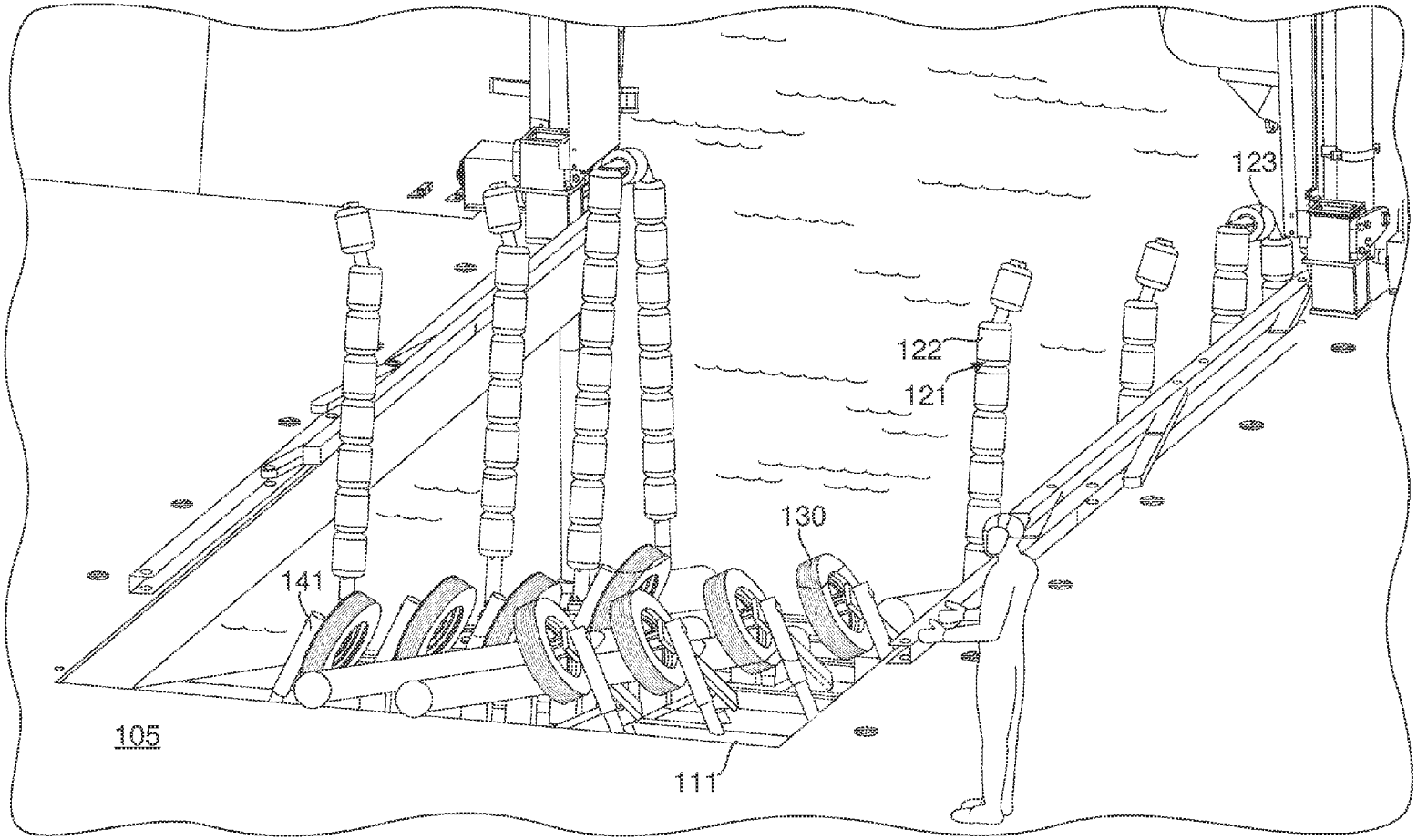

FIGS. 2A-2B are exemplary illustrations of the universal launch and recovery arrangement 200, according to embodiments of the invention. As shown, the universal launch and recovery arrangement 200 includes a ramp 110, which may have a rectangular shape. The ramp 110, which has a substantially planar surface, is pivotally attached by means of a hinge arrangement or other known means, to a surrounding surface 105 at a pivot edge 111. The ramp also includes a forward edge 112, and side edges 113 and 114. Thus the ramp 110 is pivotable about the pivot edge 111 between a stowed position shown in FIG. 2A, and a deployed position shown in FIG. 2B. According to embodiments of the invention, when in the deployed position, about 50% to about 90% or more of the ramp may be submerged below the surface of the surrounding water. As shown in FIG. 2B, in the deployed position, the forward edge 112 extends downwards, and in at sea application is typically submerged. FIG. 2A shows power sources 117 and 118 located on either side of the ramp 110. The power sources 117 and 118 may be electric motors, which may be attached to pneumatic/hydraulic cylinders 107 and 108 attached to respective pneumatic/hydraulic arrangements, which when activated, moves the ramp 110 between the stowed position and the deployed position.

FIGS. 2A and 2B further illustrate two vertical guide bars sets 120*a* and 120*b* positioned around outer portions of the ramp 110. As outlined below, the two vertical guide bar sets 120*a* and 120*b* are provided to guide water vessels 150 onto and off the ship 101, or any structure associated with the ramp 110. The adjustability of the vertical guide bar sets 120*a* and 120*b*, also outlined below, enables the launching and recovery of water vessels having different geometries, as shown in FIG. 1.

As shown, a first set of the vertical guide bars 120*a* are located generally in the vicinity of the outer ramp edge 113, and the second set of the vertical guide bars 120*b* generally located in the vicinity of the outer ramp edge 114. As shown, the vertical guide bar sets include vertical soft guide bars 121. Each bar 121 may include a plurality of stacked rollers 122, with each roller 122 rotatable about a substantially vertical axis. The rollers may be made from a soft material such as a plastic or an elastomeric material, or combinations thereof. The softness of the material, as well as the rotatable mounting of the roller assists with cushioning and guiding functions. FIGS. 2A and 2B also show the first two adjacent guide bars of each set, joined at a top end, forming a substantially V-shaped arrangement 123. As outlined below, during recovery operations, the substantially V-shaped arrangements 123 are the first to contact the water vessel being recovered, and V-shaped arrangements 123 optimize the redistribution of forces associated with the initial contact between the water vessel 150 and the ramp 110.

FIGS. 2A and 2B also show a plurality of linear rails 160 running substantially parallel to the pivot edge 111 and the forward edge 112 of the ramp 110. Bottom ends 125 of the vertical guides are slidably positioned with respect to the linear rails 160. The linear rails 160 are positioned along the substantially planar ramp surface. The lateral positioning of each vertical guide bar 121 can be adjusted by sliding the guide bar within the linear rail 160. As shown, each linear rail 160 includes two vertical guide bars 121, one bar 121 at each outer portion of each linear rail 160. In each linear rail 160, the two vertical guide bars are slidable towards and away from each other, to accommodate for water vessels 150 having different geometries. Because of the arrangement in which two vertical guide bars are positioned in each linear rail 160, the two vertical guide bars work in tandem to position the water vessel 150 towards the central portion of the ramp, enabling safer and more secure launching and recovering/receiving operations.

Figure 2C:
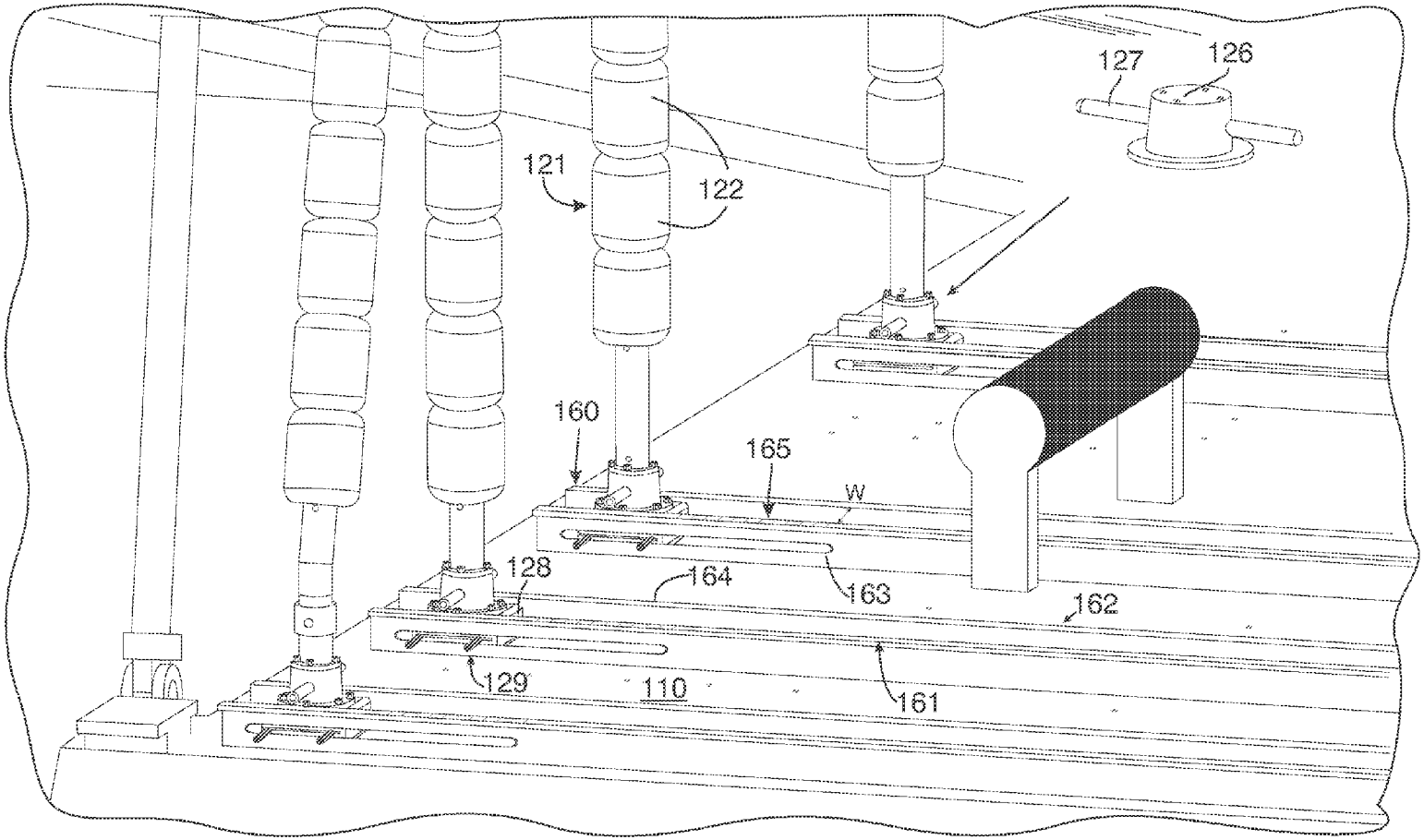
FIG. 2C is an exemplary illustration of relationship between a vertical guide bar and linear rails, according to an embodiment of the invention.

FIG. 2C illustrates the adjustable arrangement of the vertical guide bars 121 with respect to the linear rails 160. FIG. 2C shows a lower end 125 of each vertical guide bar 121, with each lower end 125 having a substantially cylindrical base 126 with two protruding arms 127, which function as hand grips to manually move or adjust the lateral positioning of the vertical guide bars 121 within the linear rails 160. As shown, each linear rail 160 includes a front face 161 and a back face 162. FIG. 2C also shows the cylindrical base 126 resting on top of a rectangular platform 128. Each rectangular platform 128 fits within a rail 160, with the distance between the front face 161 and back face 162 of the rails 160, W, being about equal to the width of the rectangular platform 128. The rectangular platform 128 includes protruding bolts 129, with each bolt having a large washer (not shown) that allows an operator to secure the bolt 129 and the vertical guide bar 121 at a desired lateral position within the rail 160. FIG. 2C also shows the linear rails 160 having elongated slots 163 in the front face 161, through which the bolts 129 extend. The bolts 129 ride a track within the elongated slots 163 when the vertical guide bars 121 are being adjusted into a desired position. The elongated slots 163 are located at extreme ends of each rail 160 to allow the adjustment of a vertical guide bar 121 of set 120*a* and a vertical guide bar 121 of set 120*b*, to ensure the proper alignment of the guide bars.

FIG. 2C also shows the linear rails 160 having calibrated surface markings 165 to further ensure the proper alignment of the bars. The calibrated surface markings 165 allow the crew to adjust the vertical guide bars 121 to position commensurate with the beam of the boat being retrieved. As shown, the marked surface 168 is located on the upper ridge surface of the linear rails 164, upon which the protruding arms 127 rest, the arms 127 also act as visible indicators to establish the correct spacing between the vertical guide bars. This arrangement insures that the water vessel 150, regardless of its geometry, will always center itself on the ramp 110. Although FIG. 2C shows the elongated slots 163 being formed only in the front face 161 of the guide rails 160, a corresponding elongated slot may also be formed in the back face 162. According to this embodiment, the rectangular platform 128 includes bolts 129 that extend through the slots 163 in the front face 161 and bolts that extend through the back face slot.

In operation, in order to make a lateral adjustment of a vertical side bar, the bolts 129 are loosed by releasing the washers associated with the bolts. After releasing the washers, an operator then pulls the protruding arms/hand grips 127 to a desired marking on the upper ridge surface 164 to a position commensurate with the beam of the water vessel 150 that being launched or retrieved. During the adjustment, the vertical guide bar 121 is supported by the bolts 129, which in turn are supported on a track within the elongated slot 163. As stated above, the rectangular platform 128 fits within the rails 160, with the distance between front and back rails 161 and 162, W, being about equal to the width of the rectangular platform 128. The inside of the rails 160 may be coated with a layer of polyoxymethylene that allows the rectangular platform 128 to slide freely therewithin.

Figure 2D:
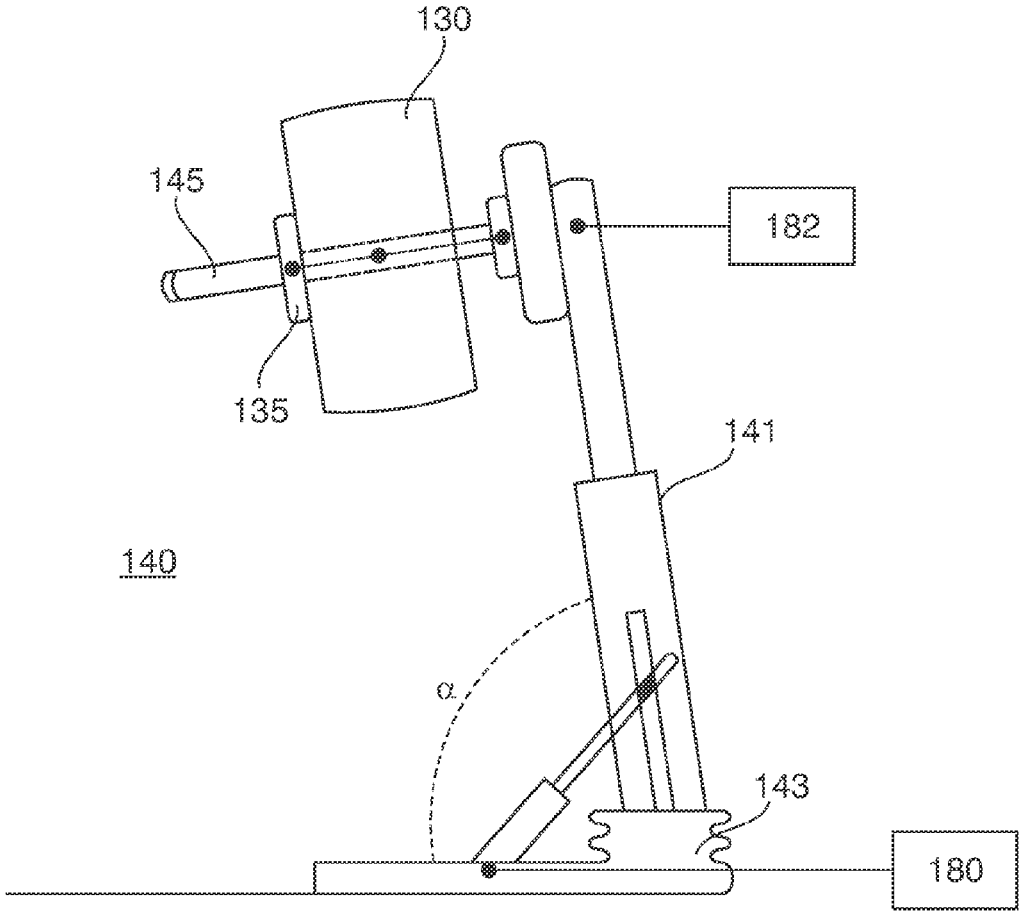
FIG. 2D is an exemplary illustration of a tire arrangement, according to an embodiment of the invention.

FIGS. 2A and 2B also show tire arrangements 140, arranged in first and second rows 140*a* and 140*b* at a central region of the ramp 110. The first and second rows 140*a* and 140*b* are arranged substantially parallel to each other and are provided to carry the hull of a water vessel thereon. FIG. 2D is an exemplary illustration of a tire arrangement 140, according to an embodiment of the invention. As shown, each tire arrangement 140 includes an extendable arm 141, which may be a pneumatic arm, powered by power source 180, which may be an electric motor, for example. Each arm 141 may extend or retract to a height commensurate with the geometry of the water vessel that is being carried by the tire arrangements 140. Each extendable arm 141 may be a two link arm, with one link slidable within the other. As shown, a lower portion of the extendable arm 141 is supported on the substantially planar surface of the ramp 110 on a pivotable joint 143. The pivotable joint 143 is adjustable to maintain the extendable arm 141 at various $\alpha$ angles between 0 degrees and 90 degrees, with respect to the ramp surface 110. The angle $\alpha$ is also selected to be commensurate with the geometry of the water vessel that is being carried by the tire arrangements 140. For example, for a larger water vessel 150 having a deeper hull, the angle $\alpha$ may be smaller than for a water vessel 150 having a shallower hull. The pivotable joint 143 may also include a pneumatic arm powered by a power source 180.

As shown in FIG. 2D, an axle 145 is attached to an upper portion of each extendable arm 141. Each axle is attached at an upper portion of each respective extendable arm 141 at an angle of about 90 degrees, and rotatably supports a tire 130 thereon. Each tire 130 may be freely rotatable, or may be drivingly rotatable in both forward and reverse directions. The free rotation may be a reduced speed free rotation by incorporating a gearing system, capping rotation velocity only up to a desired low velocity, which is particularly advantageous when launching water vessels, 150 down the ramp 110. When driven, as shown in FIG. 2C, the tire arrangements 140 may all be connected to a common reversible motor 182 that drives the tires 130 simultaneously by a known transmission arrangement. Each tire 130 includes a braking arrangement 135 to stop rotation of the tire 130. The braking arrangement 135 may be a tandem arrangement so that all brakes are applied in tandem to each tire 130. For example, the braking arrangement 135 may be a hydraulic braking arrangement having disc brakes on each tire, that simultaneously engage a tire surface upon actuation from a master cylinder. In operation, during launching or recovering/receiving a water vessel 150, when the water vessel 150 is being carried on the tire arrangements 140, the application of the brakes assist in preventing the rollback of the water vessel 150 down the downwardly sloping ramp 110.

Returning to FIGS. 2A and 2B, a pair of emergency lugs 136 and 138 positioned towards the forward edge 112 of the ramp 110 are shown. The first emergency lug 136 is aligned to be substantially parallel with the first row of tire arrangements 140*a*, and the second emergency lug 138 is aligned to be substantially parallel with the second row of tire arrangements 140*b*. The emergency lugs 136 and 138 may be made from a solid elastomeric or plastic material, or the like, providing both resilience and traction. During the launching and recovering/receiving of a water vessel, if the braking arrangement 135 of the tires 130 fail, the lugs 136 and 138 act as an emergency brake, preventing rollback down and off the ramp 110. As outlined above, the lugs 136 and 138 are aligned to be substantially parallel to the first and second tire arrangement rows 140*a* and 140*b*, respectively. Thus if the braking arrangement 135 fails, and the water vessel 150 slides or rolls off the tires, the lugs 136 and 138 are positioned to intercept the water vessel and bring the water vessel to a stop, preventing damage to the vessel and/or injury to personnel.

FIGS. 2A, 2B, and 2C show the rows of tire arrangements 140*a* and 140*b* each inclined towards each other at the adjustable angle $\alpha$. As illustrated, the extendible arms 141 of each row 140*a* and 140*b* are equally extended. Thus rows 140*a* is symmetrical with respect to row 140*b*, the two rows in tandem providing a cushioned conveyor-like arrangement for transporting water vessels 150 along the ramp 110. Because of the symmetry between the rows 140*a* and 140*b*, an equal extension of the extendable arms 141 of the first row 140*a* and the extendable arms 141 of the second row 140*b* narrows a gap between the tires 130 of the first row 140*a* and the tires 130 of the second row 140*b*.

FIGS. 2A and 2B further show first and second elongated rungs 171 and 172. The elongated rungs 171 and 172 may provide support to the first and second row of tire arrangements 140*a* and 140*b*. As shown, the first and second elongated rungs 171 and 172 are positioned and extend between the first and second rows 140*a* and 140*b* of tire arrangements. The rungs 171 and 172, which have a solid resilient outer layer of an elastomeric or plastic material, or the like, may also provide direct support for the water vessel, and may act as an emergency support if the first and second rows 140*a* and 140*b* of tire arrangements are not properly adjusted for the geometry of the water vessel that is being launched or recovered.

As shown, front ends 173 and 174 of the elongated rungs 171 and 172, respectively, may extend over the pivot edge 11 of the ramp 110 and above the cargo deck 105. According to this embodiment, because the elongated rungs 171 and 172 extend from the ramp to the cargo deck 105, a smooth transition of the water vessel 150 from the ramp 110 to the deck 105, and vice versa, is achieved. Although not illustrated, according to another embodiment, the elongated rungs 171 and 172 may be positioned entirely on the ramp 110.

Figure 3:
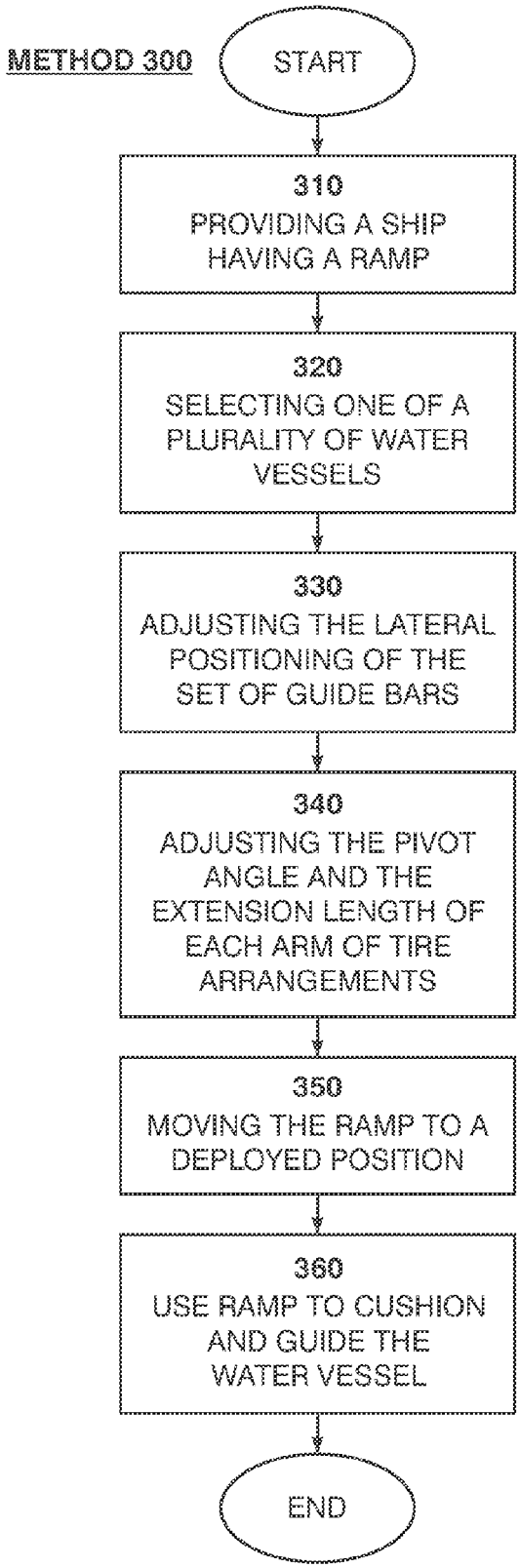
FIG. 3 is a flowchart illustrating an at sea method of launching and/or receiving water vessels, according to an embodiment of the invention.

FIG. 3 is a flowchart 300 illustrating an at sea method of launching and/or recovering/receiving water vessels 150, according to an embodiment of the invention. Steps involved in the method 300 of launching and/or receiving water vessels 150 have been outlined above in the description with respect to FIGS. 1-2D. FIG. 3 provides a broad overview of the method 300. For example, according to the method, step 310 is the providing of a ship 101 having a ramp 110. As outlined above in the description of FIGS. 1-2D, the ramp 110 is provided with first and second sets of vertically arranged laterally adjustable soft entry guide bars 120*a* and 120*b* positioned along the side edges 113 and 114 of the ramp. As outlined above, the ramp 110 also includes first and second rows of tire arrangements 140*a* and 140*b*. As shown in FIG. 2D, each tire arrangement 140 includes a tire 130 mounted on a pivotable and extendable arm 141. As shown in FIGS. 1-2B, each of the first row and second row of tire arrangements 140*a* and 140*b* are positioned between the first and second set of vertically arranged soft entry guide bars 120*a* and 120*b*.

Step 320 is the selecting of one of a plurality of water vessels 150 having different geometries for launching from the ship or for receiving onto the ship. FIG. 1 shows water vessels 150. As stated above, the vessels 150 are provided merely as examples of a myriad of smaller vessels having different geometries, which could be launched or received by the parent ship 101.

Step 330 is the adjusting of the lateral positioning of the first and second set of vertically arranged laterally adjustable soft entry guide bars 120 to a position commensurate with the geometry of the selected water vessel. As outlined above, the soft entry guide bars 121 can be adjusted by moving within the guide rails 160. Step 340 is the adjusting of the pivot angle $\alpha$ and the extension length of each arm 141 of first and second rows of tire arrangements 140*a* and 140*b* to an angle $\alpha$ and an extension length commensurate with the geometry of the selected water vessel 150. These adjustments are made prior to loading the selected water vessel 150 onto the rows of tire arrangements 140*a* and 140*b*. Step 350 is the moving of the ramp to a deployed position in which a forward edge 112 is submerged beneath the surrounding water. As outlined above, the ramp 110 may be moved by using a hydraulic/pneumatic arrangement. The deployed position in which the forward edge 112 is submerged allows for a smooth transition from the ramp 110 to the water during launching operations, or from the water to the ramp 110 during receiving operations.

Step 360 is the using of the ramp to cushion and guide the selected water vessel onto the ship during receiving operations, or off the ship during launching operations. As outlined above, because of the arrangement in which two vertical guide bars are positioned in each linear rail 160, at respective outer side edges 113 and 114, the two vertical guide bars 121 work in tandem to position the water vessel 150, towards the central portion of the ramp. According to an embodiment in which the parent ship 101 is receiving a water vessel 150 from the sea and transporting it onto a cargo deck 105, the vertical guide bars guide the water vessel 150, for proper alignment onto the tire arrangements 140. The first and second tire arrangement rows 140*a* and 140*b* then provide further cushioned guidance for the water vessel 150 as the tires 130 rotate to transport the water vessel 150 onto the cargo deck 105.

During receiving operations, the selected water vessel 150 is directed towards the ramp at a low velocity. When the parent ship 101 is at rest, the selected water vessel 150 is directed at a preferred speed of about 5 to 8 about knots. If the parent ship is moving, the preferred speed is about 5 to about 8 knots faster than the moving platform. If the water vessel 150 approaches the ramp at a speed slower than about 5 knots, an operator may attach a skiff hook to the bow eye and pull the water vessel 150 up onto the ramp 110. Water vessels 150 traveling at speeds greater than about 8 knots will engage internal brakes that will slow the vessel 150 to a manageable speed. The parent ship 101 may have a safety net that will stop the craft from launching itself forward over the ramp. The above stated velocities provide the initial momentum necessary to climb the ramp 110, but also allows for the safe reception of the water vessel 150 by the guide bar sets 120*a* and 120*b*. During receiving operations, after travelling up the ramp 110 on the tire arrangements 140*a* and 140*b*, the selected water vessel 150 may be pulled onto the cargo deck. As stated above, the elongated rungs 171 and 172 may be used to transition the water vessel 150 from the ramp 110 to the cargo deck 105. When launching a selected water vessel 150, the elongated rungs 171 and 172 may be used to transitionally guide the vessel 150 from the cargo deck 105 to the ramp 110.

According to another embodiment, in which the water vessel is being launched off the parent ship 101, the selected water vessel 150 is moved off the cargo deck 105 onto the ramp 110. Once on the ramp, the first and second tire arrangement rows 140*a* and 140*b*, via the rotating tires 130, cushion and guide the water vessel 150 downwards. As the water vessel 150 travels to a lower portion of the ramp 110, the water vessel 150 contacts the soft entry guide bar sets 120*a* and 120*b*, which further cushion and guide the water vessel 150 into the surrounding water.

What has been described and illustrated herein are preferred embodiments of the invention along with some variations. The terms, descriptions and figures used herein are set forth by way of illustration only and are not meant as limitations. For example, the method is directed to an "at sea" application. But the launching and receiving could be performed in any open-water environments, such as on lakes, rivers, manmade waterways, and the like. Additionally, several power sources are outlined above, different permutations of power sources may be used to power the various elements of the invention. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A universal launch and recovery arrangement comprising:

a pivotable ramp having a forward edge and a pivot edge, the pivotable ramp pivotable at the pivot edge, with the forward edge movable between a stowed position and deployed position for receiving a water vessel, the pivotable ramp comprising:

a substantially planar ramp surface;

a first row of tire arrangements;

a second row of tire arrangements substantially parallel to the first row of tire arrangements, wherein each tire arrangement comprises:

an adjustable pivotable joint attached to the substantially planar ramp surface;

an extendable arm having a lower portion and an upper portion, wherein the lower portion of the extendable arm is attached to the pivotable joint;

an axle attached to the upper portion of the extendable arm; and a tire for supporting a water vessel and for moving the water vessel along the ramp, the tire attached to the axle, wherein the tire is rotatable about said axle; and a pneumatic actuator for extending and retracting the extendable arm, and wherein in each tire arrangement, each adjustable pivotable joint is adjusted so that each extendable arm projects at an acute angle $\alpha$ with respect to the ramp surface, the first and second rows of tire arrangements positioned so that an equal extension of the extendable arms of the first row and the extendable arms of the second row narrows a gap between the tires of the first row and the tires of the second row.

2. The universal launch and recovery arrangement of claim 1, further comprising;

a pair of emergency lugs positioned towards the forward edge of the pivotable ramp, the lugs for providing an emergency braking surface to prevent uncontrolled roll-back of the water vessel off the ramp; and first and second elongated rungs positioned and extending between the first and second rows of tire arrangements.

3. The universal launch and recovery arrangement of claim 2, wherein each axle is attached to the upper portion of each respective extendable arm at an angle of about 90 degrees, and wherein each tire arrangement further includes a braking mechanism attached to each wheel for stopping the rotation of the wheel when the water vessel has advanced to a desired position.

4. The universal launch and recovery arrangement of claim 3, wherein the substantially planar ramp surface includes a central region, a first outer region and a second outer region, with the central region located between the first and second outer regions, and wherein the first and second row of tire arrangements and the pair of elongated rungs are all located along the central region of the substantially planar ramp surface, the universal launch and recovery system further comprising:

a first set of soft entry guide bars for guiding the water vessel, the first set of soft entry guide bars positioned along the first outer region of the substantially planar ramp surface; and a second set of soft entry guide bars for guiding the water vessel, the second set of soft entry guide bars positioned along the second outer region of the substantially planar ramp surface.

5. The universal launch and recovery arrangement of claim 4, further comprising a plurality of linear rails positioned along the substantially planar ramp surface, each of the plurality of linear rails extending from the first outer region to the second outer region, wherein each linear rail includes one of the first soft entry bars slideably attached within and one of the second set of soft entry bars slideably attached within, the first and second soft entry bars being slidably adjustable with the rail to adjust for the varying geometries of water vessels.

6. The universal launch and recovery arrangement of claim 5, wherein each of the first and second set of soft entry guide bars comprise vertically stacked rollers rotatable about a substantially vertical axis.

7. The universal launch and recovery arrangement of claim 6, wherein the pair of elongated guide rungs extend over the pivot edge to guide the water vessel onto and off the pivotable ramp.

8. The universal launch and recovery arrangement of claim 7, further comprising a ship for carrying one or more water vessels, wherein the pivotable ramp is attached to the ship.

9. An arrangement for launching and receiving multiple water vessels of various geometries, comprising:

a pivotable ramp having a forward edge, a pivot edge, a first side edge, and a second side edge, with the forward and the pivot edges substantially perpendicular to the first and second side edges, the pivotable ramp pivotable at the pivot edge so that the ramp moves between a stowed position and deployed position for receiving a water vessel, the pivotable ramp comprising:

a first set of vertically arranged soft entry guide bars positioned along the first side edge of the ramp for guiding water vessels of various geometries onto and off of the ramp; and a second set of vertically arranged adjustable soft entry guide bars substantially parallel to the first set of vertically arranged soft entry guide bars for guiding water vessels of various geometries onto and off of the ramp, the second set of vertically arranged adjustable soft entry guide bars positioned along the second side edge of the ramp, the first and second set of vertically arranged soft entry guide bars guiding water vessels onto and off the pivotable ramp;

the arrangement for launching and receiving multiple water vessels further comprising a plurality of linear rails positioned along the substantially planar ramp surface in a direction substantially perpendicular to the first and second side edges of the ramp, wherein each linear rail includes one of the first soft entry bars slideably attached within and one of the second set of soft entry bars slideably attached within, said first and second soft entry bars being slidably adjustable within the rail towards and away from each other to adjust for the varying geometries of water vessels.

10. The arrangement for launching and receiving multiple water vessels of claim 9, wherein two adjacent guide bars of the first set of vertically arranged soft entry guide bars, positioned at the forward edge, are joined at a top end forming a substantially V-shaped pressure distribution arrangement, and wherein a corresponding two adjacent guide bars of the second set of vertically arranged soft entry guide bars, positioned at the forward edge, are joined at a top end forming a substantially V-shaped pressure distribution arrangement, for absorbing and distributing the initial impact when receiving a water vessel.

11. The arrangement for launching and receiving multiple water vessels of claim 10, further comprising:

a first row of tire arrangements comprising a row of tires for supporting water vessels thereon; and a second row of tire arrangements substantially parallel to the first row of tire arrangements, comprising a row of tires for supporting water vessels thereon, each of the first row and second row of tire arrangements positioned between the first and second set of vertically arranged bars.

12. The arrangement for launching and receiving multiple water vessels of claim 11, wherein each tire arrangement of the first and second rows of tire arrangements comprises an extendable pneumatic arm pivotably attached to the ramp at a bottom end of the extendable pneumatic arm, and one of the tires attached at a top end of the extendable pneumatic arm.

13. The arrangement for launching and receiving multiple water vessels of claim 12, further comprising:

a pair of emergency lugs positioned towards the forward edge of the pivotable ramp providing an emergency braking surface to prevent rollback off the ramp.

14. The arrangement for launching and receiving multiple water vessels of claim 13, wherein each of the first and second set of vertically arranged soft entry guide bars has a lower end having a protruding arm which acts as a handle to be held by an operator for sliding the associated entry guide bar, and wherein each linear rail includes calibrated surface markings, and wherein a protruding arm is aligned by an operator with a selected surface marking on an associated linear rail to slidably position the guide bar within the rail to adjust for the geometry of a water vessel.

15. The arrangement for launching and receiving multiple water vessels of claim 14 further comprising a ship having a cargo deck for carrying one or more water vessels, wherein the pivotable ramp is attached to the cargo deck of the ship.

16. An at sea method of launching and/or receiving water vessels having different geometries, the method comprising:

providing a ship having a ramp, the ramp comprising:

a first set of vertically arranged laterally adjustable soft entry guide bars positioned along a first side edge of the ramp;

a second set of vertically arranged laterally adjustable soft entry guide bars substantially parallel to the first set of vertically arranged soft entry guide bars, positioned along a second side edge of the ramp;

a first row of tire arrangements comprising tires mounted on a pivotable and extendable arm;

a second row of tire arrangements substantially parallel to the first row of tire arrangements comprising tires mounted on a pivotable and extendable arm, each of the first row and second row of tire arrangements positioned between the first and second set of vertically arranged soft entry guide bars;

selecting one of a plurality of water vessels having different geometries for launching from the ship or for receiving onto the ship;

adjusting the lateral positioning of the first and second set of vertically arranged laterally adjustable soft entry guide bars to a position commensurate with the geometry of the selected water vessel;

adjusting the pivot angle and the extension length of each arm of first and second rows of tire arrangements to an angle and an extension length commensurate with the geometry of the selected water vessel;

moving the ramp to a deployed position in which a forward edge is submerged beneath the surrounding water; and using the ramp to cushion and guide the selected water vessel onto the ship during launching or off the ship during receiving.

17. The at sea method of launching and/or receiving water vessels as outlined in claim 16, wherein during the receiving of the water vessel, the method comprises:

directing the selected water vessel at a reduced speed towards the ramp;

cushioning and guiding the selected water vessel towards a central region of the ramp and onto the first and second rows of tire arrangements by contacting the water vessel with the laterally adjusted first and second set of vertically arranged soft entry guide bars;

further directing the selected water vessel along the ramp by rotating the tires of the first and second rows of tire arrangements;

applying a break to the tires to prevent roll-back when the selected water vessel advances a predetermined distance along the ramp; and pulling the selected vessel off the ramp into the cargo area of the ship.

18. The at sea method of launching and/or receiving water vessels as outlined in claim 16, wherein during the launching of the water vessel, the method comprises:

directing the selected water vessel from a cargo deck onto the first and second rows of tire arrangements of the ramp;

rotating the tires of the tire arrangement to guide and cushion the selected water vessel downwards towards the first and second set of vertically arranged soft entry guide bars; and contacting the sides of the water vessel with the first and second set of vertically arranged soft entry bars to guide and smoothly transition the water vessel into the water.

* * * * *